US007632124B2

(12) United States Patent
Kennedy et al.

(10) Patent No.: US 7,632,124 B2
(45) **Date of Patent: *Dec. 15, 2009**

(54) ELECTRICAL CONNECTOR AND SOCKET ASSEMBLIES FOR SUBMERSIBLE ASSEMBLY

(75) Inventors: Steven Charles Kennedy, Houston, TX (US); Michael Andrew Yuratich, Hamble (GB); Trevor Alan Kopecky, Dayton, TX (US); Alan Thomas Fraser, Crowthorne (GB)

(73) Assignee: Premier Business Solutions, Ltd., Midland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/187,585

(22) Filed: Aug. 7, 2008

(65) Prior Publication Data

US 2008/0293280 A1 Nov. 27, 2008

Related U.S. Application Data

(60) Continuation of application No. 11/848,937, filed on Aug. 31, 2007, which is a division of application No. 11/295,348, filed on Dec. 6, 2005, now Pat. No. 7,264,494.

(30) Foreign Application Priority Data

Dec. 6, 2004 (GB) ..... 0426585.6

(51) Int. Cl.
*H01R 13/52* (2006.01)

(52) U.S. Cl. ..... 439/274; 439/587; 310/87

(58) Field of Classification Search ..... 439/274, 439/275, 322, 623, 580, 587; 310/87
See application file for complete search history.

(56) References Cited

U.S. PATENT DOCUMENTS 3,077,572 A 2/1963 Zimmerman
3,568,771 A 3/1971 Vincent et al.

(Continued)

FOREIGN PATENT DOCUMENTS

DE 1004892 3/1957
DE 2826607 11/1979

(Continued)

OTHER PUBLICATIONS

Sung-Jun Kim, et al., "A novel filter design for suppression of high voltage gradient in voltage-fed PWM inverter," APEC '97 Conference, Feb. 23, 1997, 122-127, XP010215809.

*Primary Examiner*—Hae Moon Hyeon
(74) *Attorney, Agent, or Firm*—Patterson & Sheridan, LLP

(57) ABSTRACT

An electrical connector assembly for a cable having a plurality of insulated conductors comprises a body having a respective recess for receiving a terminating pin each of the conductors. A respective spigot sealingly engages within each of the recesses and has a passage for receiving an associated one of the terminating pins. Furthermore a seal is associated with each of the spigots for sealing the spigot relative to the associated terminating pin. The provision of a separate spigot for each of the conductors and for sealing engagement within a respective recess in the body enables the spigots to be sealingly fitted to the conductors prior to each spigot being introduced into its recess and sealingly engaged therein. This provides improved insulation of the conductor and increased creepage distance between the mating electrical parts and the outer surface of the housing of the assembly. It also provides the additional advantage that the seal on the conductor tends to be smaller than in prior arrangements so that there is less thermal expansion of the seal when the parts get hot in a downhole environment.

21 Claims, 9 Drawing Sheets

U.S. PATENT DOCUMENTS

| | | | |
|---|---|---|---|
| 3,780,428 | A | 12/1973 | Zorev et al. |
| 3,997,232 | A | 12/1976 | Dunaway |
| 4,204,739 | A | 5/1980 | Shoenleben |
| 4,310,211 | A | 1/1982 | Bunnell et al. |
| 4,330,740 | A | 5/1982 | Shell et al. |
| 4,434,389 | A | 2/1984 | Langley et al. |
| 4,477,967 | A | 10/1984 | Yabuoshi et al. |
| 4,586,774 | A | 5/1986 | Didier |
| 4,623,830 | A | 11/1986 | Peneder et al. |
| 4,643,506 | A | 2/1987 | Kobler |
| 4,713,021 | A | 12/1987 | Kobler |
| 4,912,353 | A | 3/1990 | Kondo et al. |
| 4,995,838 | A | 2/1991 | Ayer et al. |
| 5,035,638 | A | 7/1991 | Kourimsky |
| 5,051,634 | A | 9/1991 | Overton |
| 5,203,723 | A | 4/1993 | Ritter |
| 5,207,273 | A | 5/1993 | Cates et al. |
| 5,278,354 | A | 1/1994 | Lhomme |
| 5,350,960 | A | 9/1994 | Kiri et al. |
| 5,567,170 | A | 10/1996 | Kroeber |
| 5,580,282 | A | 12/1996 | Paterek |
| 5,588,858 | A | 12/1996 | Lester et al. |
| 5,605,193 | A | 2/1997 | Bearden et al. |
| 5,606,791 | A | 3/1997 | Fougere et al. |
| 5,700,161 | A | 12/1997 | Plummer et al. |
| 5,923,111 | A | 7/1999 | Eno et al. |
| 6,000,915 | A | 12/1999 | Hartman |
| 6,010,348 | A | 1/2000 | Alden |
| 6,047,461 | A | 4/2000 | Miura et al. |
| 6,193,474 | B1 | 2/2001 | Tetzlaff |
| 6,218,754 | B1 | 4/2001 | Alekperov et al. |
| 6,254,353 | B1 | 7/2001 | Polo et al. |
| 6,318,467 | B1 | 11/2001 | Liu et al. |
| 6,388,353 | B1 | 5/2002 | Liu et al. |
| 6,429,568 | B1 | 8/2002 | Shen et al. |
| 6,515,384 | B1 | 2/2003 | Kikuchi et al. |
| 6,582,251 | B1 | 6/2003 | Burke et al. |
| 6,601,651 | B2 | 8/2003 | Grant |
| 6,621,005 | B1 | 9/2003 | Lovec et al. |
| 6,676,447 | B1 | 1/2004 | Knox |
| 6,700,236 | B2 | 3/2004 | Umeda et al. |
| 6,794,788 | B1 | 9/2004 | Smith et al. |
| 7,264,494 | B2 | 9/2007 | Kennedy et al. |
| 2002/0057031 | A1 | 5/2002 | Ueda et al. |
| 2002/0063486 | A1 | 5/2002 | Huth |
| 2002/0063488 | A1 | 5/2002 | Ooiwa |
| 2002/0068568 | A1 | 6/2002 | Qing-An |
| 2003/0116323 | A1 | 6/2003 | Pettigrew |
| 2003/0193260 | A1 | 10/2003 | Reiter et al. |
| 2003/0214196 | A1 | 11/2003 | Cai et al. |
| 2004/0016105 | A1 | 1/2004 | Johnson et al. |
| 2004/0095035 | A1 | 5/2004 | Sogabe et al. |
| 2005/0095891 | A1 * | 5/2005 | Schorn ..... 439/274 |
| 2005/0186823 | A1 | 8/2005 | Ring et al. |
| 2008/0067887 | A1 | 3/2008 | Toyoda et al. |

FOREIGN PATENT DOCUMENTS

| | | |
|---|---|---|
| DE | 3907516 | 9/1990 |
| DE | 10207310 | 9/2003 |
| EP | 0342554 | 11/1989 |
| EP | 0644645 | 3/1995 |
| EP | 0986161 | 3/2000 |
| EP | 1102383 | 5/2001 |
| EP | 1107433 | 6/2001 |
| EP | 1422806 | 5/2004 |
| EP | 1742327 | 1/2007 |
| GB | 393466 | 6/1933 |
| GB | 537833 | 7/1941 |
| GB | 545101 | 5/1942 |
| GB | 1062096 | 3/1967 |
| GB | 1304204 | 1/1973 |
| GB | 2003333 | 8/1977 |
| GB | 2052319 | 1/1981 |
| GB | 2210733 | 6/1989 |
| GB | 2248524 | 4/1992 |
| GB | 2256094 | 11/1992 |
| GB | 2264811 | 9/1993 |
| GB | 2302892 | 2/1997 |
| GB | 2362762 | 11/2001 |
| GB | 2362901 | 12/2001 |
| GB | 2391395 | 2/2004 |
| GB | 2438551 A * | 11/2007 |
| JP | 07201404 | 8/1995 |
| JP | 2001054244 | 2/2001 |
| JP | 2001161039 | 6/2001 |
| JP | 2001210426 | 8/2001 |
| JP | 2002027688 | 1/2002 |
| JP | 2002078258 | 3/2002 |
| JP | 2002345184 | 11/2002 |
| JP | 2003003985 | 1/2003 |
| JP | 2003173839 | 6/2003 |
| JP | 2003217697 | 7/2003 |
| JP | 2004343856 | 12/2004 |
| KR | 20050066006 | 6/2005 |
| WO | WO-8403400 | 8/1984 |
| WO | WO-9733070 | 9/1997 |
| WO | WO-2004021548 | 3/2004 |

* cited by examiner

ELECTRICAL CONNECTOR AND SOCKET ASSEMBLIES FOR SUBMERSIBLE ASSEMBLY

CROSS-REFERENCE TO RELATED APPLICATIONS

This application is a continuation of U.S. patent application Ser. No. 11/848,937, filed Aug. 31, 2007, which is a divisional of U.S. patent application Ser. No. 11/295,348, filed Dec. 6, 2005, now U.S. Pat. No. 7,264,494, which claims priority from British Application Serial Number 0426585.6, filed Dec. 6, 2004. Each of the aforementioned related patent applications is herein incorporated by reference in its entirety.

BACKGROUND OF THE INVENTION

1. Field of the Invention

This invention relates to electrical connector assemblies for cables having a plurality of insulated conductors, and to socket connector assemblies for electrical connection to such connector assemblies, and is more particularly, but not exclusively, concerned with such connector and socket assemblies for use with electric submersible pumps and compressors.

2. Description of the Related Art

Electric submersible pumps (ESP) are installed in subterranean wells for extracting hydrocarbons where the natural pressure in the reservoir is insufficient to lift the fluid or gas to the surface. The ESP motor is powered through a cable that connects the motor to a power source at the surface. The cable is connected to the motor by means of a detachable electrical connector assembly designed to provide electrical integrity and to seal the motor against the ingress of well fluids.

U.S. Pat. No. 5,567,170 discloses a plug-in type electrical connector assembly that can be used to connect the cable to the ESP motor. In this arrangement the motor is provided with a machined port, called a pothole, and the motor windings are terminated at a socket assembly within the pothole into which the connector assembly can be plugged. In this case the pothole is a single round hole containing a single socket connector block containing terminals that are connected to the motor windings by means of braided wire leads. The socket connector block is mechanically secured to the motor housing independently of its connection to the windings.

The connector assembly terminating the power cable that is run from the surface, called the pothead, is inserted into the pothole and is sealed against the ingress of well fluids by an elastomeric gasket or an O-ring.

The pothole is machined at an angle to the axis of rotation of the motor for ease of manufacturing. However, the angled pothole limits the length of the mating electrical parts of the connector and socket assemblies, and consequently limits the length of insulating material that can be provided around the parts to provide a long creepage distance between the outside of the connector assembly and the electrical interface between the connector and socket assemblies. It is important to provide as long a creepage distance as practically possible as a significant failure mechanism in such connection arrangements is electrical tracking from the live electrical parts to the motor housing, exacerbated by ingress of moisture after operation over many months or years.

Furthermore, because the primary seal with respect to each conductor from the cable bears against the conductor insulation and the conductor insulation is liable to swell when subjected to the high temperature environment of the well, the seal integrity is compromised.

U.S. Pat. No. 6,676,447 discloses a further plug-in type electrical connector assembly for an ESP motor in which three insulated conductors from the cable extend through three separate passages in a first insulating block and are sealed within these passages by means of separate washers compressed by three protrusions extending from a second insulating block screwed to the first insulating block. Such an arrangement suffers from the fact that the primary seal with respect to each conductor bears against the conductor insulation and the conductor insulation is liable to swell when subjected to the high temperature environment of the well. Furthermore, as the elastomeric materials of the insulation and the seal increase in volume, the insulation can be damaged or the seal integrity diminished.

U.S. Pat. No. 3,997,232 discloses a motor connector assembly that is attachable to the top of the motor housing by way of a pothole extending parallel to the motor axis. Motors with thrust bearings in the top cannot have the connector on top of the motor as it is not possible for the three insulated conductors from the cable to be passed beyond the bearing. However the three insulated conductors from the cable extend through three parallel passages in a common sealing gland, and thus there are again difficulties in terms of the integrity of the seals in a downhole environment.

U.S. Pat. No. 4,204,739 discloses a motor connector assembly having separate potholes for each conductor. Each conductor is provided with a strain relief and seal assembly that is tightened in the motor head independently of the assemblies of the other conductors. However each of the conductors is sealed within the corresponding pothole by a respective O-ring seal, so that there are difficulties in assembly as well as in the integrity of the sealing as a result of the direct sealing of the O-ring seal on the conductor insulation. Also there is insufficient strain relief for the conductors with the result that there is a risk that the conductors will be pulled out of the motor when it is installed in a well.

U.S. Pat. No. 5,700,161 discloses a two-piece pothead casting that is assembled in two halves and that is split radially across the conductors. However the three insulated conductors from the cable extend through three passages in a common insulating block, and thus there are again difficulties in terms of the integrity of the sealing in a downhole environment. Typically, in such arrangements, the motor head, within which the pothole is formed, is required to be screwed into the tubular motor housing during assembly. This means that there is little control over the relative rotational positions of the pothole and the motor stator within the housing. Furthermore the flexible leads connecting the stator windings to the socket connector block within the pothole tend to be wound around the motor shaft as the motor head is screwed into the motor housing, a protective tube being provided to separate the leads from the shaft. Such winding of the leads around the motor shaft during assembly can introduce further possible failure mechanisms, and it is not possible to observe the twisted motor leads and their connection to the stator windings once the motor head has been assembled with the motor housing. Any resulting chafing, cuts or strain on the internal electrical joints may not be revealed during initial electrical testing but may remain as a weak point during long-term service.

It is an object of the invention to provide an electrical connector assembly and corresponding electrical socket assembly that avoids many of the pitfalls associated with known assemblies.

SUMMARY OF THE INVENTION

According to one aspect of the invention there is provided an electrical connector assembly for a cable having a plurality of insulated conductors, the connector assembly comprising: a body having a respective recess for receiving each of the conductors; a respective spigot for sealing engagement within each of the recesses and having a passage for receiving an associated one of the conductors; and sealing means associated with each of the spigots for sealing the spigot relative to the associated conductor.

The provision of a separate spigot for each of the conductors and for sealing engagement within a respective recess in a body of the assembly enables the spigots to be sealingly fitted to the conductors prior to each spigot being introduced into its recess and sealingly engaged therein. When provided in a motor the separate spigot allows the conductor terminal to be parallel with the motor shaft and therefore permits an elongated connector assembly internal to the motor. This provides improved insulation of the conductor and increased creepage distance between the mating electrical parts and the outer surface of the housing of the assembly. It also provides the additional advantage that the seal on the conductor tends to be smaller than in prior arrangements so that there is less thermal expansion of the seal when the parts get hot in a downhole environment.

According to a further aspect of the present invention, there is provided an electrical socket assembly for electrical connection to an electrical connector assembly for a cable having a plurality of insulated conductors, the socket assembly comprising: a housing having a respective recess for receiving an end of each of the conductors; a respective socket part for sealing engagement with each of the recesses and having a passage for detachably receiving the associated conductor end for electrical connection thereto; and a respective electrically insulating sleeve surrounding each of the socket parts.

Such an arrangement permits a relatively long creepage path between the mating electrical parts and the outer surface of the housing of the assembly.

According to a further aspect of the present invention, there is provided an electrical connector assembly for a cable having a plurality of insulated conductors, the connector assembly comprising a body having a respective recess for receiving each of the conductors; a respective conductive terminating pin connected to an end of each of the conductors; and a respective sealing means acting between an outer surface of each terminating pin and an inner surface of the corresponding recess.

Such an arrangement has the advantage that the primary sealing means with respect to the conductor no longer bears against the conductor insulation that is liable to swell when subjected to the high temperature downhole environment. Instead the sealing means bears against the outer surface of the conductive terminating pin which is much more stable at high temperatures. An insulating barrier preferably covers the pin/conductor connection to provide increased electrical integrity. Most preferably the barrier is sealed with elastomeric calk, with a crimped lead sheath or by crimping of the barrier itself to a lead sheath so as to render the connection gas tight.

BRIEF DESCRIPTION OF THE DRAWINGS

In order that the invention may be more fully understood, preferred embodiments in accordance with the invention will now be described, by way of example, with reference to the accompanying drawings, in which.

DETAILED DESCRIPTION OF THE PREFERRED EMBODIMENT

The embodiments of the invention described below with reference to the drawings relate to the connection of power cables to the motors of ESP's, although it will be appreciated that other connector and socket assemblies in accordance with the invention can be used for other purposes, and this particular application is only given by way of example.

Figure 1:
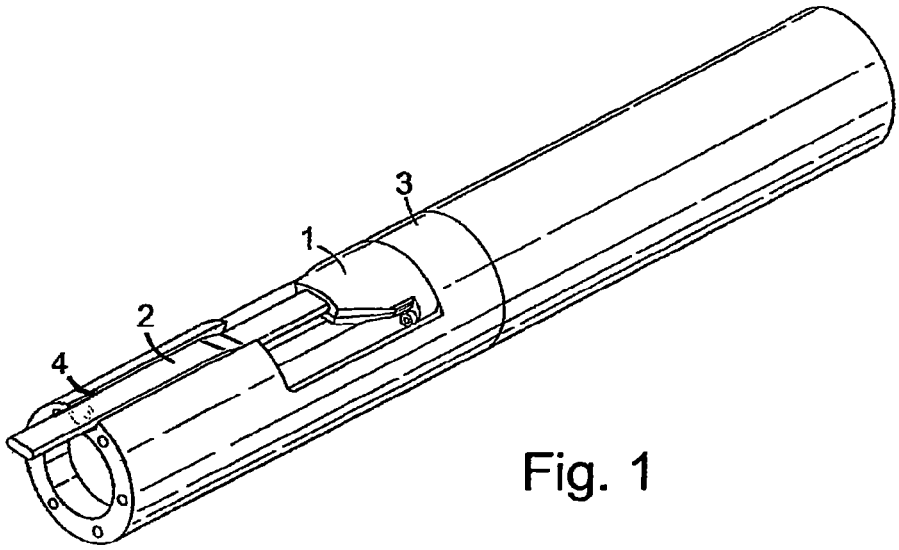
FIG. 1 is a perspective view of the connector assembly attached to the motor in a first embodiment.

Referring to FIG. 1, this shows the electrical connector assembly 1, that is the pothead, and the end of a cable 2 for supplying power from the surface plugged into the motor head 3 so as to establish an electrical connection with the windings of the motor stator. As shown the cable 2 extends within a slot 4 in the motor head 3.

The cable used is typical for ESP applications and contains multiple conductors that have one or more layers of insulation with one or more layers of protective material. Three conductor flat cable with an interlocking metal armour with each conductor protected by a lead sheath, EPDM (ethylene propylene diene monomer rubber) insulator jacket, and Kapton insulation is used in the described embodiments but those skilled in the art will be aware that other types of cable can be used with slight modification to the connector.

Figure 2:
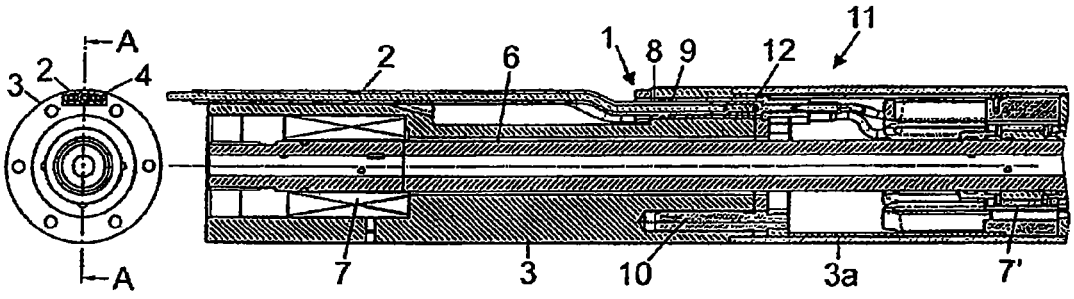
FIG. 2 is an axial section through parts of the motor and connector assembly.

In the axial section through the motor head 3, the motor housing 3*a* and the pothead 1 shown in FIG. 2, the motor shaft 6 journalled within the motor housing 3*a* by bearings 7 and 7' can be seen. An end view of the motor head 3 is shown on the left-hand side of the figure in which the location of the cable 2 containing three insulated conductors within the slot 4 in the motor head 3 can be seen, the sectional view being taken along the line A-A. Each of the insulated conductors is terminated by a respective spigot 8 sealed within a recess 9 of the connector assembly, as will be described in more detail below. The connector assembly 1 is shown plugged into a corresponding socket assembly 11 incorporating a respective socket 12 for receiving the associated conductor end for electrical connection thereto.

Figure 3:
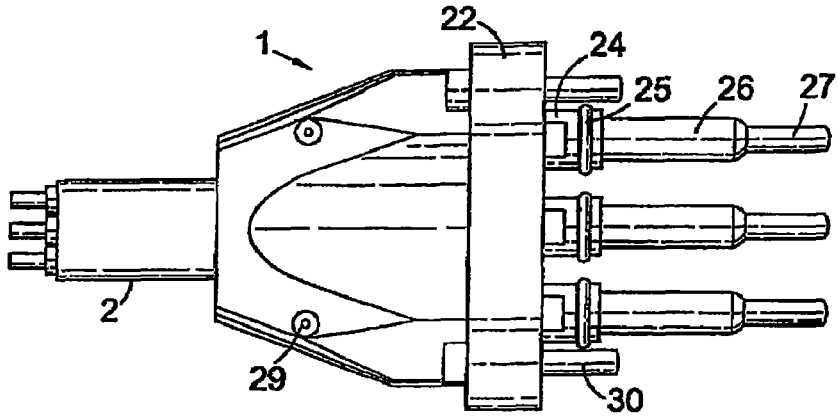
FIGS. 3 and 4 show the connector assembly in assembled and disassembled states.
Figure 4:
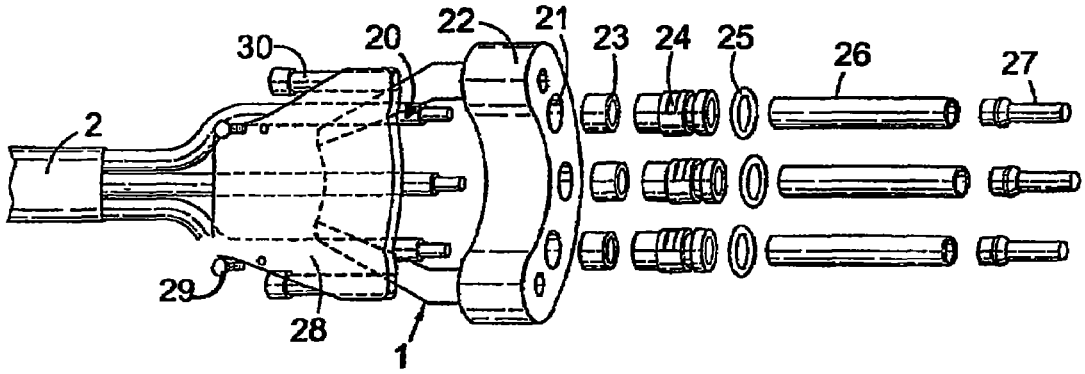

Referring to the assembled and disassembled views of the connector assembly shown in FIGS. 3 and 4, each of the three insulated conductors 20 extends through a respective one of three screwthreaded recesses 21 formed in an arcuate configuration in a first casting part 22 and has an elastomeric sealing gland 23, a threaded spigot 24 fitted with an O-ring 25, a PEEK insulating sleeve 26 and a conductive terminating pin 27. The insulating sleeve 26 is bonded to the insulation of the conductor 20 in order to protect the insulation from motor oil and any trace gas that permeates into the motor. This is necessary because the insulation (EPDM) swells and deteriorates unless protected from such motor oil and will experience explosive decompression from gas permeation.

In order to seal the spigot on each conductor 20, the sealing gland 23 is located between a shoulder in each recess 21 and the end of the spigot 24 so as to be compressed as the spigot 24 is screwed into the screwthreaded recess 21. The resulting compression of the sealing gland 23 serves to compress the outer surface of the insulation of the conductor 20 by means of the inside surface of the sealing gland 23, as well as compressing the outer surface of the sealing gland 23 against the inner surface of the recess 21 and the end surfaces of the sealing gland 23 against the shoulder and the end of the spigot 24, thus providing fluid-tight sealing of the conductor 20 within the recess 21. Such compressive sealing can be assisted by causing each recess 21 to taper inwardly towards the shoulder on which the sealing gland 23 is seated.

As best seen in FIG. 3, each of the spigots 24 protrudes from the casting 22 when screwed fully within its corresponding recess and has its associated O-ring 25 fitted so as to be accommodated within an annular groove in the outer surface of the spigot 24. Furthermore the insulating sleeve 26 extends between the end of the spigot 24 and the terminating pin 27 soldered onto the exposed end of the conductor 20. The O-rings 25 serve to seal the spigots 24 with respect to the corresponding receiving sockets of the socket assembly as described in more detail below. A second casting part 28 is connected to the first casting part 22 by screws 29 so that the conductors 20 pass between the two casting parts 22 and 28. If required the cavity between the casting parts 22 and 28 can be filled with epoxy to improve the strain relief on the cable 2. If no epoxy is used the cable 2 can be clamped by the clamping force produced when the two casting parts are screwed together. Alternatively a one-piece casting can be provided with a space through which the conductors are passed, with the cavity surrounding the conductors optionally being filled with epoxy to provide the strain relief on the cable. Screw fasteners 30 are provided for mechanically securing the connector assembly to the motor housing when the connector assembly is plugged into the socket assembly.

Figure 5:
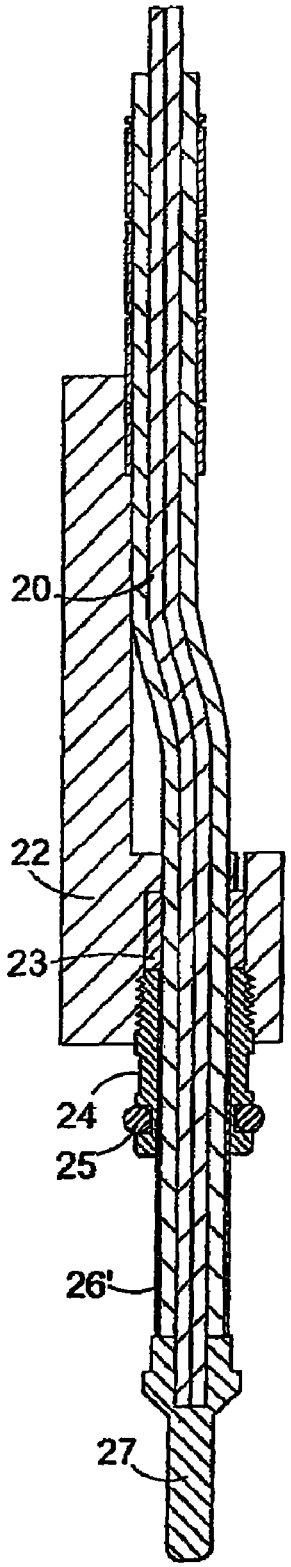
FIGS. 5, 6 and 7 are axial sections through corresponding parts of three different embodiments of the connector assembly.
Figure 6:
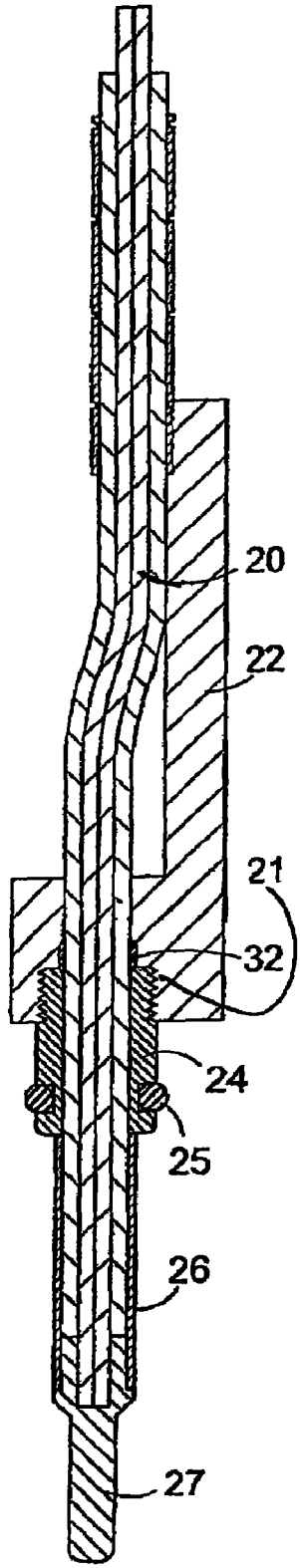
Figure 7:
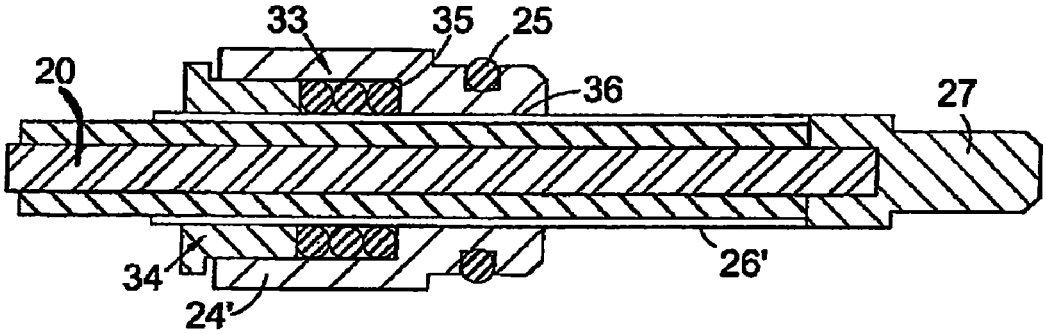

Various modifications of the above-described arrangement for sealing the spigot on the conductor are possible within the scope of the invention, and three such alternative arrangements are shown in FIGS. 5, 6 and 7. The arrangement of FIG. 5 is substantially similar to that described above with reference to FIGS. 3 and 4 except that the insulating sleeve 26 extending between the end of the spigot 24 and the terminating pin 27 is replaced by a longer sleeve 26' that also extends through the axial passage within the spigot 24. This is intended to provide improved sealing.

In the case of the arrangement of FIG. 6, the sealing gland 23 is replaced by a compression sleeve 32 fitted to the outer surface of the conductor 20 and positioned to be compressed between angle sections on the spigot 24 and the inside wall of the recess 21 as the spigot 24 is screwed into the recess 21. Otherwise the arrangement is similar to that described with reference to FIGS. 3 and 4.

In the arrangement of FIG. 7, the spigot 24' is provided with a shoulder 35 in the passage 36 through which the conductor 20 (and the insulating sleeve 26') extends, and the required sealing of the spigot 24' on the conductor 20 is effected separately from the subsequent screwing of the spigot 24' into the associated recess in the casting. One or more O-rings 33 are located between the shoulder 35 in the passage 36 and a compression nut 34 that is screwed into a screwthreaded portion of the passage 36 to compress the O-rings 33 into engagement with the outer surface of the insulating sleeve 26'. Only after sealing of the spigot 24' on the conductor 20 in this manner is the spigot 24' screwed into the associated recess in the casting so that the portion of the spigot 24' bearing the O-ring 25 projects from the casting in the manner shown in FIGS. 3, 5 and 6. In other, non-illustrated variants the spigot is not engaged within the recess by screwing but instead is a press fit within the recess by the engagement of complementary formation on the spigot and the inside of the recess, or a slip fit with a snap ring being provided to engage within a receiving groove in the inside wall of the recess. Alternatively the spigot may simply be arranged to be trapped between the two casting halves when these are screwed together, installed with a retaining ring, or bonded within the recess by adhesive. In the trapped configuration, the spigot could have limited float to allow for tolerance variations in the mating parts.

Various other arrangements can be contemplated within the scope of the invention but are not separately illustrated. For example an elastomeric gland element may be moulded into the inside surface of the spigot so as to provide an interference fit relative to the outer surface of the conductor to form the required fluid-tight seal. As a further alternative a stack of O-rings may be fitted to the underside surface of the conductor so as to provide an interference fit with the inside surface of the passage extending through the spigot. As a further alternative a stack of O-rings may be fitted to the outside surface of the conductor so as to engage the inside surface of the recess in the casting when compressed by screwing of the spigot into the recess. It will also be understood that the O-rings shown in the illustrated embodiment of FIG. 7 may be replaced by an elastomeric sealing gland or some other sealing element.

Figure 8:
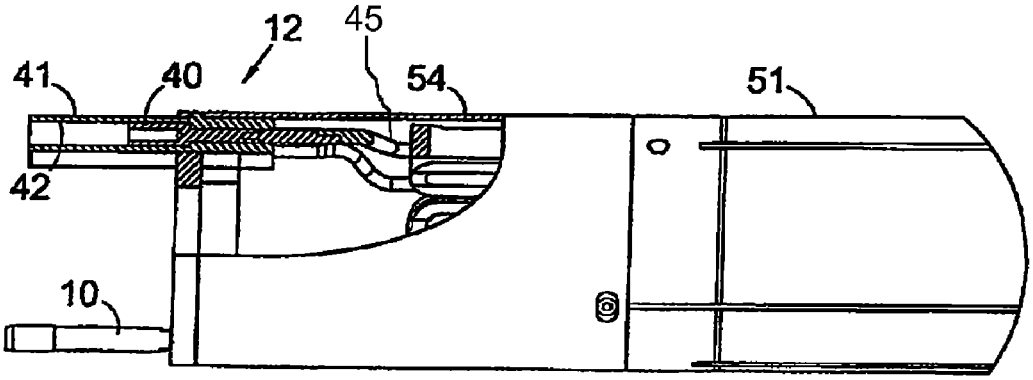
FIG. 8 is an axial section through parts of interengaging connector and socket assemblies in accordance with the first embodiment.

FIG. 8 shows the mating parts of the socket assembly into which the connecting parts of the connector assembly are plugged as shown in FIGS. 1 and 2, only one of the three sockets being shown in section in the figure. In this case the terminating pin 27 provided at the end of each conductor 20 engages within a corresponding socket part 40 provided within a long insulating sleeve 41 of the socket assembly defining a bore 42. The socket parts are accommodated within a conductive canister 54 that is in turn connected to stator 51 as described in more detail below. The conductor 20 with the insulating sleeve 26 and terminating pin 27 thereon is inserted into the insulating sleeve 41 to provide a long creepage distance between the interconnecting conductive parts and the outside of the connector assembly.

The insulating sleeves 41 are inserted into the corresponding recesses 9 in the motor head when the stator is installed in the motor housing. The O-ring 25 on the spigot seals on the inner wall of recess 9 in the motor head to provide a fluid tight seal for the motor. Other possible, non-illustrated arrangements for sealing of the spigot with respect to the internal surface of the bore can be contemplated within the scope of the invention. Instead of the O-ring provided for this purpose a seal may be moulded on the outside surface of the spigot so as to provide the required sealing with respect to the inside surface of the bore. Alternatively a custom moulded seal could be fitted to the outside of the spigot to provide an interference fit with the inside surface of the bore. As a further alternative a seal may be provided that seals between a shoulder on the spigot and the end of the bore or the face of the end plate of the motor head.

Instead of, or in addition to, the insulating sleeve 26, 26' surrounding the conductor 20, ptfe (polytetrafluiroethylene) tape may be wound around the portion of the conductor 20 to be insulated to provide protection and added insulation and to protect the insulation from motor oil and contaminants.

Figure 9:
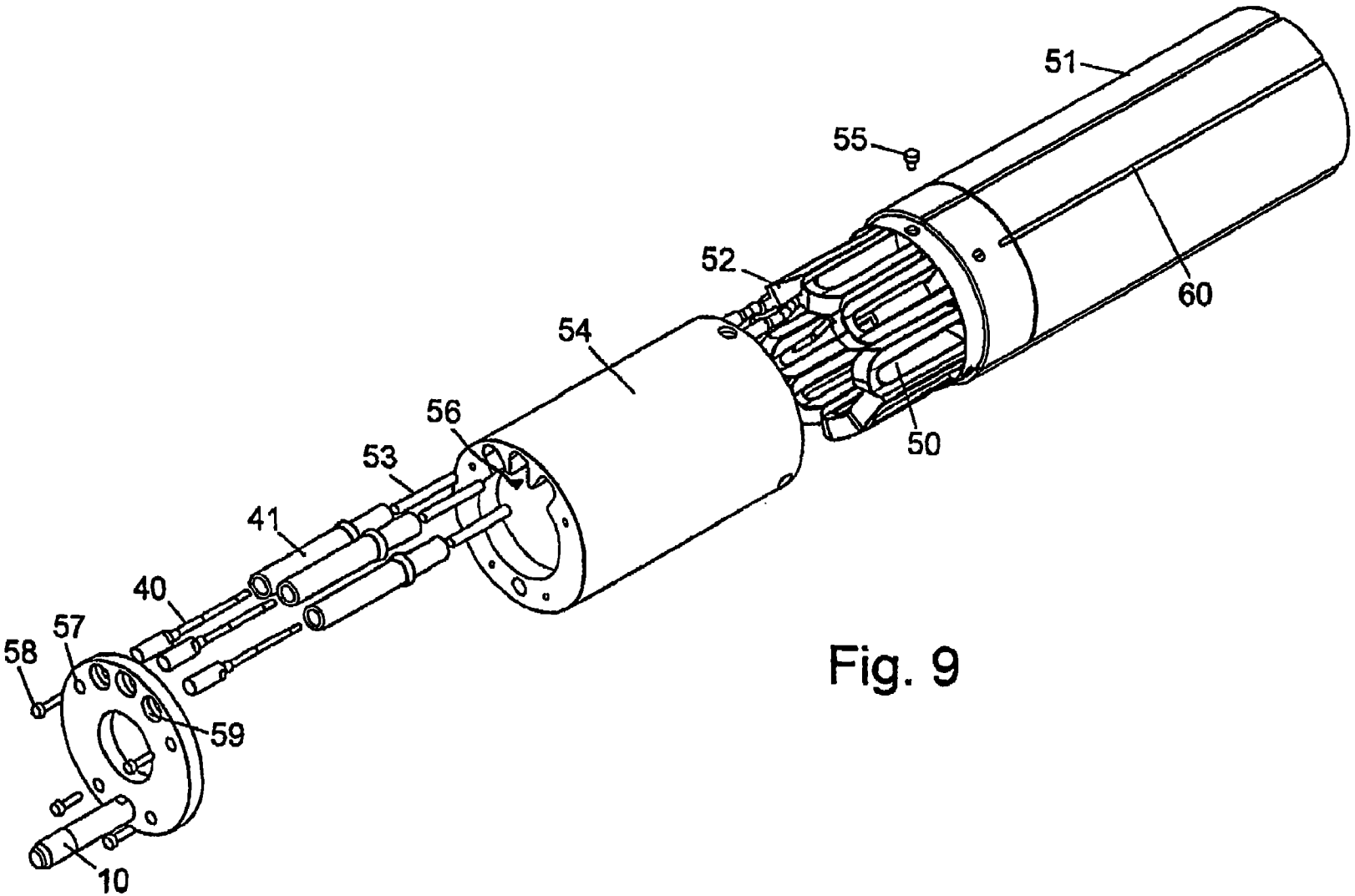
FIG. 9 is an exploded perspective view of the socket assembly and associated motor.

The construction of the socket assembly is best understood by reference to the exploded view of FIG. 9 showing the stator windings 50 within the stator housing 51 and the coil terminations 52 of the stator windings. Each coil termination 52 is connected to a flat end region of a conductive socket part 40 by a wire 45 (FIG. 8), and each socket part 40 is accommodated within a respective insulating sleeve 41 that extends forwardly of the socket part 40 as shown in FIG. 8. In addition a further, smaller insulating sleeve 53 is provided around the narrowed end portion of the socket part 40. The insulating sleeve 53 enters the end of the insulating sleeve 41 so as to ensure a long creepage path at the rear of the assembly, and insulating tape is wound around the connecting lead from the stator winding up to and over the sleeve 53. After assembly of these parts the canister 54 is passed over the parts and secured to the end of the stator housing 51 by screws 55, and the sheathed socket parts 40 are moved radially outwardly so as to engage them within receiving notches 56 prior to screwing of an end plate 57 to the end of the canister 54 by means of screws 58 so as to align the socket parts 40 with holes 59 in the end plate 57. The insulating sleeves 41 can float radially to a small extent within the holes in the end plate 57 during the final alignment stage of stator insertion.

A guiding pin 10 projects from the end plate 57 for the purpose of locating the three sockets parts 40 in the required orientation when the stator is inserted into the motor housing. The guiding pin 10 engages first to ensure proper alignment before the more fragile insulating sleeves 41 engage within their respective holes. Some designs will not require the guiding pin 10 to protect the insulating sleeves during insertion.

Because the stator and its associated connector parts are first assembled and then inserted as a whole into the motor housing, it is necessary to ensure the correct alignment of the stator and the pothole. Since no access to the motor connections is required during the subsequent assembly process, it is possible for the motor head to be welded to the motor housing, thus eliminating the need for a threaded joint and seal. Additionally it is preferred that the stator 51 is provided with a keyway 60 for engagement with a complementary formation on the inside surface of the motor housing so as to locate the stator with the correct orientation within the motor housing. In this case it follows that, if the motor head is welded to the motor housing with the correct orientation, then the stator will necessarily be in the required alignment with respect to the pothole so that the motor connections enter the potholes during the last stage of insertion. Such keying also provides the additional operational advantage that no strain is put on the motor windings as the connections are always mechanically guided without deflection or twisting. A known failure mechanism of existing motors is that, during initial motor starting before the stator has warmed up and differentially expanded against the housing to grip it, the torque reaction of the stator to the rotor can cause the stator to rotationally slip in the rotor housing resulting either in instantaneous motor failure by shearing of the windings or damage to the conductor insulation in such a manner as to lead to subsequent failure. This known failure mechanism is eliminated by the keying arrangement described above.

Figure 10:
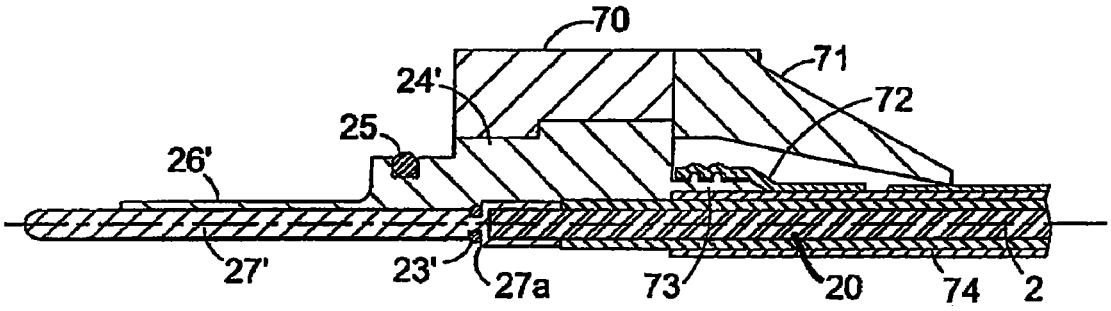
FIGS. 10 to 16 are axial sections through parts of further embodiments of the invention (FIGS. 10 and 12 showing only half of the section in each case)

FIG. 10 is a section (only half of the section being shown) through one of the conductors 20 of a further embodiment of connector assembly in accordance with the invention. In this embodiment the terminating pin 27' is of extended length so as to permit sealing of the spigot 24' with respect to the terminating pin 27' by means of an O-ring seal 23' seated against a shoulder 27*a* of the terminating pin 27', rather than such sealing being with respect to the wire insulation of the conductor as in the previously described embodiments. This is advantageous because the terminating pin 27' does not swell to any appreciable extent under the high operating temperatures, and thus the seal is not compromised to the same extent as it would be if made with the insulation of the conductor. Furthermore the spigot 24' is integral with an insulating sleeve 26' surrounding the terminating pin 27', rather than the spigot and insulating sleeve forming separate components as in the previously described embodiments. In addition the spigot 24' is formed with a terminating bush 73 having a profiled outer surface over which a lead jacket 72 is swaged in order to provide a gas-tight connection between a lead sheath 74 of the conductor 20 and the spigot 24'. The spigot 24' is provided with an outer O-ring seal 25. The assembly is encased within a two-part casting comprising a bottom casting part 70 and a top casting part 71 which are screwed together so as to surround the assembly with the top casting part 71 engaging the armour surrounding the cable 2.

Figure 11:
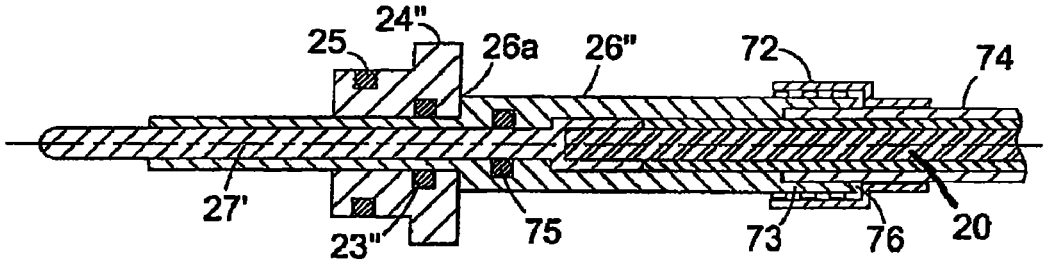

In a further embodiment shown in FIG. 11, the spigot 24" is a separate part from the insulating sleeve 26", and surrounds a portion of the insulating sleeve 26" so as to engage with the shoulder 26*a* thereon. In this case an O-ring seal 75 is provided between the inside of the insulating sleeve 26" and the outside of the terminating pin 27', and a further O-ring seal 23" is provided between the insulating sleeve 26" and the spigot 24". Furthermore the insulating sleeve 26" is provided with a profiled bush 73 over which a lead jacket 72 is swaged for establishing a fluid-tight connection between the insulating sleeve 26" and the lead sheath 74 of the conductor 20. An adhesive filler or sealant 76 is provided between the insulation of the conductor 20 and the insulating sleeve 26". This embodiment also has the advantage that the primary seal is provided between the insulating sleeve 26" and the conductive terminating pin 27' so that the integrity of the seal is maintained at high temperatures.

Figure 12:
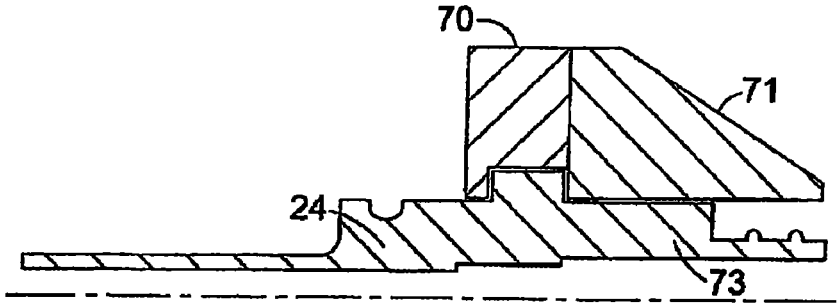

A variant of the embodiment of FIG. 10 is shown in FIG. 12, the conductor 20, the terminating pin 27' and the various seals being omitted from this figure in order to render it easier to read. In this case the spigot 24' with its integral insulating sleeve is a loose fit within the two-part casting in order to allow it to float with respect to the casting for alignment purposes during installation in the motor.

Figure 15:
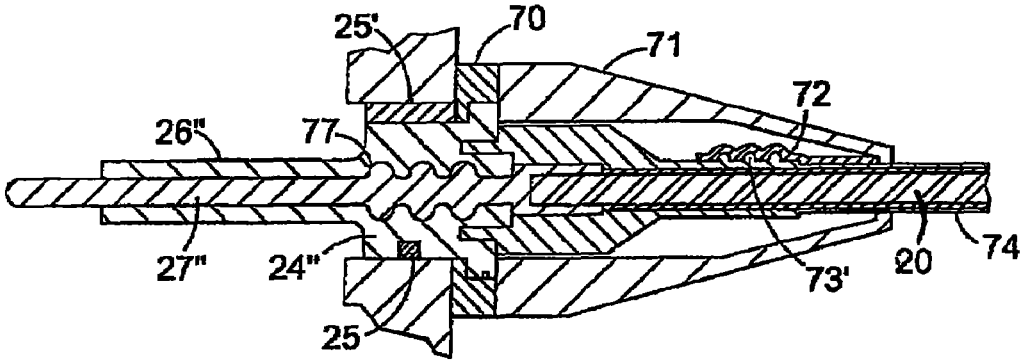

A further variant of the embodiment of FIG. 10 is shown in FIG. 15. In this case the terminating pin 27" is moulded into the insulating sleeve 26" and formed with ribs 77 providing added strength and sealing within the sleeve 26". The insulating sleeve 26" is integral with the spigot 24" which is bonded to a separate terminating bush 73' by way of a special bonding joint. The spigot 24" is provided with either an O-ring seal 25 (as shown at the bottom of the figure) or an elastomeric sealing member 25' (as shown at the top of the figure). In addition the gap between the casting part 71 and the terminating bush 73' may be filled with a sealing compound, such a Viton caulk compound, to improve the sealing and provide improved strain relief on the cable.

Figure 13:
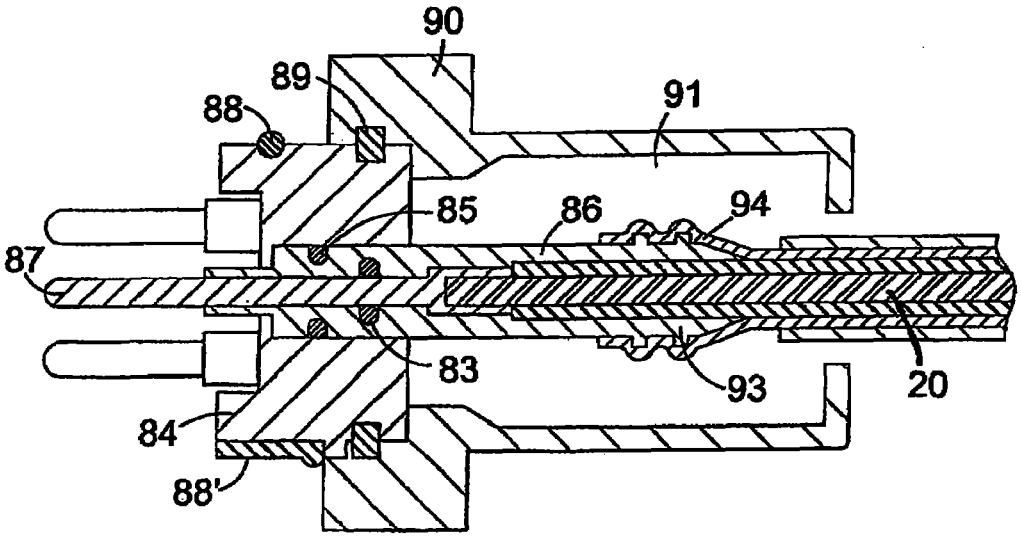

FIG. 13 shows a further embodiment of the invention as applied to a connector assembly of a more standard type in which the three conductors extend through recesses in a common insulator block 84 retained within a generally cylindrical casting 90 by means of a retaining ring 89. The external circumference of the insulator block 84 is sealed with respect to the motor head when the connector is inserted into a corresponding socket by means of either an O-ring 88 (as shown at the top of the figure) or an elastomeric sealing member 88' (as shown at the bottom of the figure). As in the previously described embodiments, the conductor 20 is terminated by a conductive terminating pin 87 surrounded by an insulating sleeve 86 sealed with respect to the terminating pin 87 by an O-ring seal 83 and having in addition an O-ring seal 85 for sealing the outside of the insulating sleeve 86 within the recess extending through the insulator block 84. As in the previously described embodiments, the insulating sleeve 86 is formed with a profiled bushing 93 over which the lead sheath 94 of the conductor 20 may be directly swaged. If required a lead sleeve or other gas impermeable membrane sleeve or tape could be used to seal the lead sheath 94 of the motor cable to the insulating sleeve 86. Furthermore the gap between the casting 90 and the conductor 20 may be filled with an epoxy or liquid fluoroelastomer compound to improve the sealing with respect to the conductor 20 and provide improved strain relief on the cable.

Figure 14:
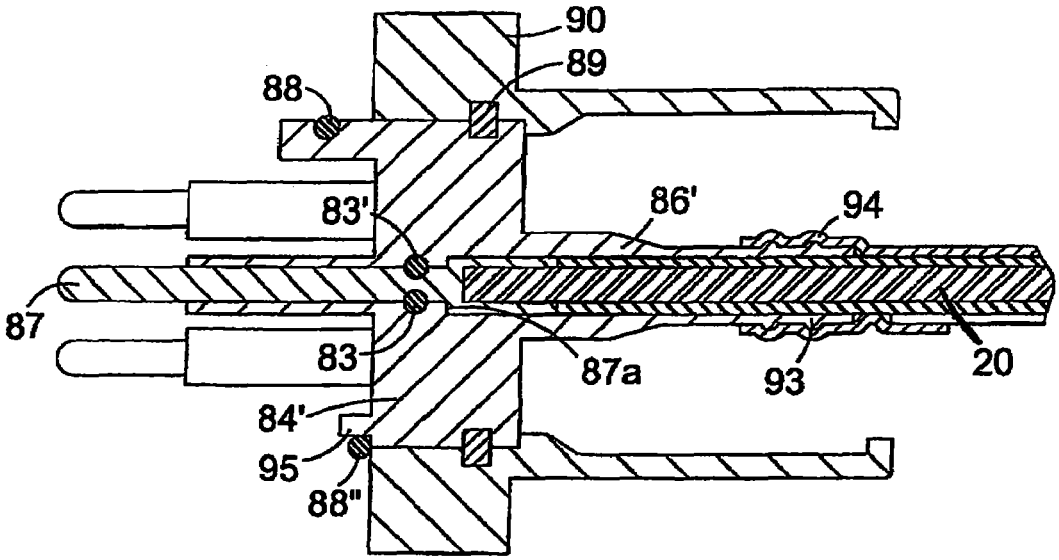

FIG. 14 shows a further embodiment that is generally similar to the embodiment of FIG. 13 but that has an insulating sleeve 86' formed integrally with its insulator block 84', rather than the two parts constituting distinct components as in the embodiment of FIG. 13. In this case the primary sealing between the insulating sleeve 86' and the conductive terminating pin 87 is provided either by an O-ring seal 83 (as shown in the lower part of the figure) or by an O-ring seal 83' (as shown in the upper part of the figure) engaging against a shoulder 87*a* on the terminating pin 87. Furthermore the sealing between the insulator block 84' and the motor head on connection of the connector to a corresponding socket is effected either by an O-ring seal 88 (as shown in the upper part of the figure) or an O-ring seal 88" (as shown in the lower part of the figure) engaging against an outer shoulder 95 on the insulator block 84'.

Figure 16:
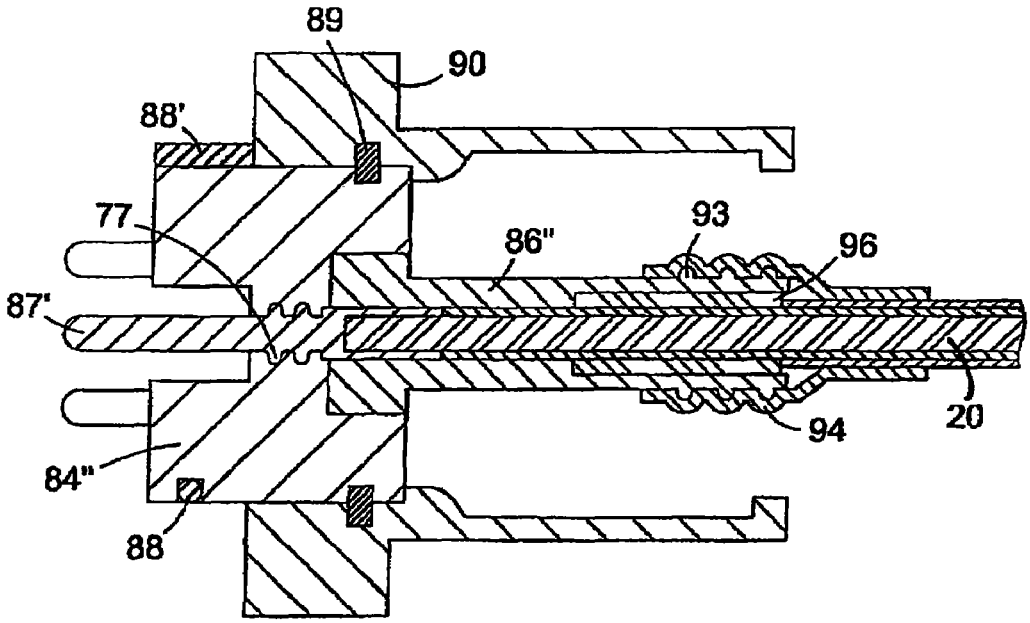

A further variant is shown in FIG. 16. In this case the terminating pin 87' is formed with ribs 77 and is moulded within the insulator block 84". The insulator block 84" is bonded to a separate insulating sleeve 86", and an elastomeric filler 96 is provided between the insulating sleeve 86" and the conductor 20 to improve sealing.

In each of the above described embodiments the method of assembly of the connector is as follows. Each of the conductors 20 is prepared by removal of the armour of the cable, the lead sheath and the insulation of the conductor to the required lengths. The copper conductor end is then soldered or crimped within the terminating pin. The conductor with the pin thereon is then inserted into the insulating sleeve, and preferably bonded therein with adhesive. In the case of the embodiments of FIGS. 15 and 16 the terminating pin is moulded within the insulator block so that a special conductor assembly procedure is required. Where provided, the lead jacket is then swaged over the end of the insulating sleeve and the conductor sheath. If required the lead jacket can be soldered to the sheath. If required the lead sheath on the conductor can be expanded prior to insertion of the terminating pin into the insulating sleeve so that the lead sheath slides over the insulating sleeve and can be swaged thereon. The connector assembly is then inserted into the pothead casting, and, if required, filler material may be poured into the cavity intermediate the casting and the conductors to anchor the connector to the cable and provide strain relief for the cable.

In the description of the connector assembly O-rings are used to seal the assembly. If required, the O-rings could be replaced with other fluid barrier seals, such as T-rings, quad rings, U-cup seals, chevron packs, etc. Furthermore the internal O-rings could be replaced by liquid sealants, such as Aflas Caulk or injected moulded compounds.

Figure 17:
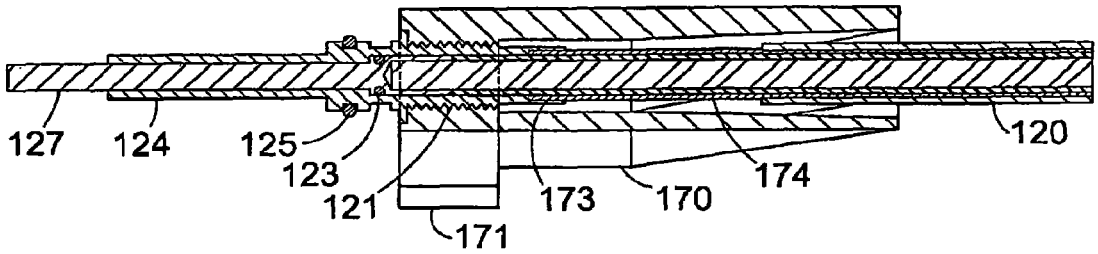
FIG. 17 is an axial section through part of a preferred embodiment of the invention.
Figure 18:
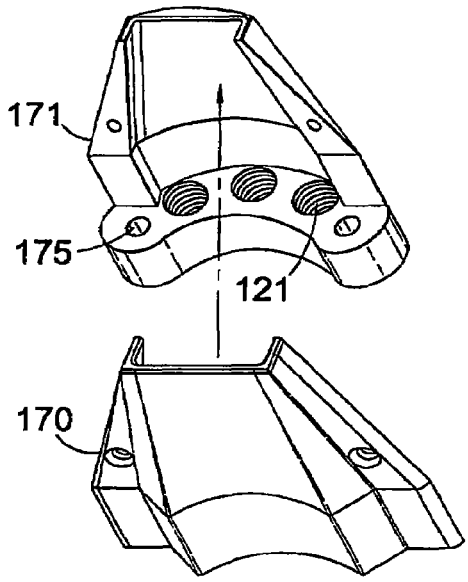
FIG. 18 is an exploded perspective view of top and bottom casting parts of the preferred embodiment of the invention.

One of the conductors 120 of a preferred embodiment of the invention is shown in axial section in FIG. 17. As in the embodiment of FIG. 10, the terminating pin 127 is of extended length so as to permit sealing of the spigot 124 with respect to the terminating pin 127 by means of an O-ring seal 123 seated within an annular recess in the terminating pin 127. Furthermore an outer O-ring seal 125 is provided within an annular recess in the spigot 124 as in a number of the previously described embodiments. The spigot 124 is screwed into a screwthreaded recess 121 in a top casting part 171 of a two-part casting, as shown in FIG. 18. In addition the spigot 124 is formed with a terminating bush 173 for engaging over a lead sheath 174 of the conductor 120. The assembly is encased within the two-part casting together with two similar assemblies, with the top and bottom casting parts 171 and 170 being screwed together so as to surround the assembly, and is connected to the motor housing by fasteners extending through holes 175 in the upper casting part 171 as shown in FIG. 18.

The invention claimed is:

1. An electrical connector assembly for connecting a cable having a plurality of insulated conductors to a submersible assembly comprising a motor head, the connector assembly comprising:

first and second connector parts for mating connection with one another, the first connector part being adapted to be connected to the cable and the second connector part being adapted to be connected to the submersible assembly;

the first connector part incorporating a body having a respective recess for each of the insulated conductors, a respective annular spigot for sealing engagement within each of the recesses and having a passage for receiving an associated one of the insulated conductors so that the conductor extends through the recess surrounded by the spigot, a respective conductive terminating pin provided at one end of each of the insulated conductors and projecting forwardly of the body, and inner sealing means within the passage of each of the spigots for sealing the spigot relative to the insulated conductor extending therethrough or the terminating pin thereon, outer sealing means on each of the spigots; and the second connector part incorporating a respective recess for receiving each of the terminating pins of the first connector part such that the outer sealing means is caused to seal against a surface of the motor head when the first and second connector parts are placed in mating connection with one another.

2. The connector assembly according to claim 1, wherein the first connector part is detachably connectable to the motor head.

3. The connector assembly according to claim 2, wherein the first connector part is connectable to the motor head by at least one screw fastener.

4. The connector assembly according to claim 1, wherein the recesses in the body are arranged in an arcuate configuration.

5. The connector assembly according to claim 1, wherein the inner sealing means is a sealing ring extending around the inner surface of the passage through the spigot and engaging an outer surface of the terminating pin.

6. The connector assembly according to claim 1, wherein the outer sealing means comprises a respective sealing ring extending around the outer surface of each of the spigots and engaging an inner surface of the motor head.

7. The connector assembly according to claim 1, wherein the terminating pins are provided with strengthening ribs.

8. The connector assembly according to claim 1, wherein the terminating pins are moulded within the spigots.

9. The connector assembly according to claim 1, wherein a respective electrically insulating sleeve is provided for surrounding a portion of each of the conductors adjacent to an end of the conductor.

10. The connector assembly according to claim 1, wherein each of the spigots is held within its associated recess in the body by being screwed, glued or snap-fitted into the recess or by being clamped therein between two clamping parts.

11. The connector assembly according to claim 10, wherein the inner sealing means comprises a respective sealing gland located between a shoulder in each recess in the body and the associated spigot so as to be compressed as the spigot is screwed into the recess.

12. The connector assembly according to claim 11, wherein each recess in the body tapers inwardly.

13. The connector assembly according to claim 1, wherein the inner sealing means comprises a respective sealing ring extending around an inner surface of the passage through the spigot that is an interference fit with an outer surface surrounding the associated conductor.

14. The connector assembly according to claim 1, wherein the inner sealing means comprises a respective sealing ring on an outer surface surrounding each conductor that is an interference fit with an inner surface of the associated spigot.

15. The connector assembly according to claim 1, wherein the inner sealing means comprises a respective sealing ring located between a shoulder in the passage in each spigot and an associated annular compression cap so as to be compressed in engagement with an outer surface surrounding the associated conductor extending through the passage as the compression cap is screwed into the passage.

16. The connector assembly according to claim 1, wherein the recesses in the body extend substantially parallel to a motor shaft so as to permit a significant creepage distance between the outside of the connector assembly and the ends of the conductors for conductive connection to motor coils.

17. The connector assembly according to claim 1, wherein each of the recesses in the second connector part is provided with a respective electrically insulating sleeve.

18. The connector assembly according to claim 1, wherein the submersible assembly comprises an end plate having holes, recesses in the second connector part are aligned with respective holes in the end plate and the end of each conductor is passed through a respective hole when the end of the conductor is inserted into a respective recess in the second connector part.

19. The connector assembly according to claim 1, wherein the submersible assembly comprises a motor stator assembly having associated coils and conductive connections are provided between the recesses in the second connector part and the associated coils of the motor stator assembly.

20. The connector assembly according to claim 19, wherein the submersible assembly comprises a canister connected to the motor stator assembly and having notches, the recesses in the second connector part are accommodated within the canister and the recesses in the second connector part are engageable within the notches by radially outward movement after connection to the associated coils during assembly.

21. The connector assembly according to claim 1, wherein the submersible assembly comprises a guiding pin to guide insertion of the conductors into the motor head to provide mechanical alignment and electrical integrity of the recesses in the second connector part once assembled.

* * * * *